US008146217B2

(12) United States Patent
Jensen et al.

(10) Patent No.: US 8,146,217 B2
(45) Date of Patent: Apr. 3, 2012

(54) BODY BAG FOR WATER RETRIEVAL

(75) Inventors: Ronald Jensen, Chicago, IL (US); Richard Beu, Yorba Linda, CA (US)

(73) Assignee: Paper-Pak Industries, Laverne, CA (US)

( * ) Notice: Subject to any disclaimer, the term of this patent is extended or adjusted under 35 U.S.C. 154(b) by 28 days.

(21) Appl. No.: 12/790,385

(22) Filed: May 28, 2010

(65) Prior Publication Data

US 2011/0162178 A1 Jul. 7, 2011

Related U.S. Application Data

(60) Provisional application No. 61/292,002, filed on Jan. 4, 2010.

(51) Int. Cl.
*A61G 1/00* (2006.01)

(52) U.S. Cl. ..... 27/28; 383/117

(58) Field of Classification Search ..... 27/28; 383/66, 383/67, 117, 102, 103; 493/186, 212–214
See application file for complete search history.

(56) References Cited

U.S. PATENT DOCUMENTS

| | | | | |
|---|---|---|---|---|
| 4,922,562 | A * | 5/1990 | Allred et al. | 5/627 |
| 5,341,548 | A * | 8/1994 | Zerick | 27/28 |
| 5,659,933 | A * | 8/1997 | McWilliams | 27/28 |
| 5,794,747 | A * | 8/1998 | Bryant | 190/18 R |
| 6,004,034 | A * | 12/1999 | Salam | 383/66 |
| 6,092,702 | A * | 7/2000 | Cassidy, IV | 224/153 |
| 7,228,603 | B2 * | 6/2007 | Craig | 27/28 |
| 7,337,511 | B2 * | 3/2008 | Yu et al. | 27/28 |
| 7,484,275 | B2 * | 2/2009 | Carroll et al. | 27/28 |
| 7,794,146 | B1 * | 9/2010 | Geddis et al. | 383/6 |
| 2010/0003887 | A1 * | 1/2010 | Greene | 446/75 |
| 2010/0263178 | A1 * | 10/2010 | Jensen et al. | 27/28 |

FOREIGN PATENT DOCUMENTS

GB 2115690 A * 9/1983

* cited by examiner

*Primary Examiner* — William L. Miller
(74) *Attorney, Agent, or Firm* — Ohlandt, Greeley, Ruggiero & Perle, LLP

(57) ABSTRACT

A body bag for water retrieval of human remains is provided. The body bag is lightweight and disposable. The body bag is made of a material having a hole ratio per unit weight of material in a particular range that permits rapid water drainage yet provides sufficient strength and integrity to the body bag, and reduces cross-contamination. The body bag can have a skid pad on an exterior surface as an aid to lifting the body bag out of the water and over the gunwale or sides of a recovery vehicle. The body bag also can have large handles for ease of gripping and to attach buoyancy devices. The body bag further can have a snag line around its periphery.

16 Claims, 4 Drawing Sheets

BODY BAG FOR WATER RETRIEVAL

CROSS-REFERENCE TO RELATED APPLICATIONS

This application claims the benefit of U.S. Provisional Application No. 61/292,002, filed on Jan. 4, 2010, which is incorporated by reference herein.

BACKGROUND OF THE DISCLOSURE

1. Field of Disclosure

The present disclosure provides a water retrieval body bag for enclosure, recovery, and transport of human remains from bodies of water.

2. Description of the Related Art

Recovering and securing remains of deceased humans who are found in water present unique problems for a body bag.

The body bag used for water recovery must be strong enough to enclose and secure the decedent's body, yet permit water and other fluids to drain out of the body bag when taken out of the water.

In addition, the material used for the body bag must remain strong enough to secure the remains even when saturated, as when the body bag is completely submerged in water or lifted up to a boat or other recovery vehicle for further transport.

Also, since a decedent's body is often completely submerged when located, securing the decedent in the body bag may be more easily achieved underwater. Thus, the body bag with the decedent inside must be made sufficiently buoyant to be raised to the water surface for further transportation.

Another problem with water recovery of decedents is that the divers or other recovery specialists are often wearing protective gloves that restrict manual dexterity, thereby making the body bag very difficult to open and close, or grasp to pull to the side of a recovery vehicle or to shore for further transport.

Another problem specific to recovery of decedents in water is that the body bag is very difficult to pull over the gunwale or along the side of the recovery vehicle, since the body bag is heavy and has an uneven weight distribution, and the material can snag on the side of the boat or other vehicle.

Another problem for recovery of bodies in water is the risk of cross-contamination—that is, contamination of the water by the decedent's body or his body fluids, or, conversely, contamination of the decedent's body by microbes or pollutants in the water. Besides accelerating decay, cross-contamination can interfere with autopsy or investigations of the cause of death.

Conventional body bags, even for recovery of bodies in water, do not address the above problems.

SUMMARY OF THE DISCLOSURE

The present disclosure provides a water-retrieval body bag for securing the remains of deceased humans or animals found in water. The body bag of the present disclosure is lightweight, strong, and disposable.

The body bag of the present disclosure is constructed with a pre-determined ratio of holes per unit weight of material to permit rapid drainage of water and other fluids from the body bag, while providing sufficient strength and integrity to the body bag to secure the decedent's remains, even when the body bag is saturated, and to reduce cross-contamination between a decedent's body and the water.

The body bag of the present disclosure can have a skid pad, which provides a smooth surface to aid in pulling the body bag (enclosing the decedent's body) out of the water and over the gunwale or sides of a recovery vehicle.

The body bag of the present disclosure has handles that permit buoyancy devices to be attached, to assist bringing the body bag (with the decedent's body) to the water surface, and handles large enough to permit divers to grasp and pull the body bag by the handles even when wearing large diving gloves or other protective hand gear.

The body bag of the present disclosure has one or more closures about the periphery of the body bag for ease of opening and closing the body bag to enclose and secure the decedent's body. The closures can be large and/or have an easy-to-grasp device to facilitate closing the body bag around the decedent while underwater.

The body bag of the present disclosure can have a snag line connected around the periphery of the body bag. The snag line can be grappled with a boat hook, and can serve as an additional handle for divers or other recovery personnel to grasp and manipulate the body bag. The snag line can also be used to attach the body bag to a mechanical device that lifts the body bag (and decedent's body) out of the water.

DETAILED DESCRIPTION OF THE DISCLOSURE

Figure 1:
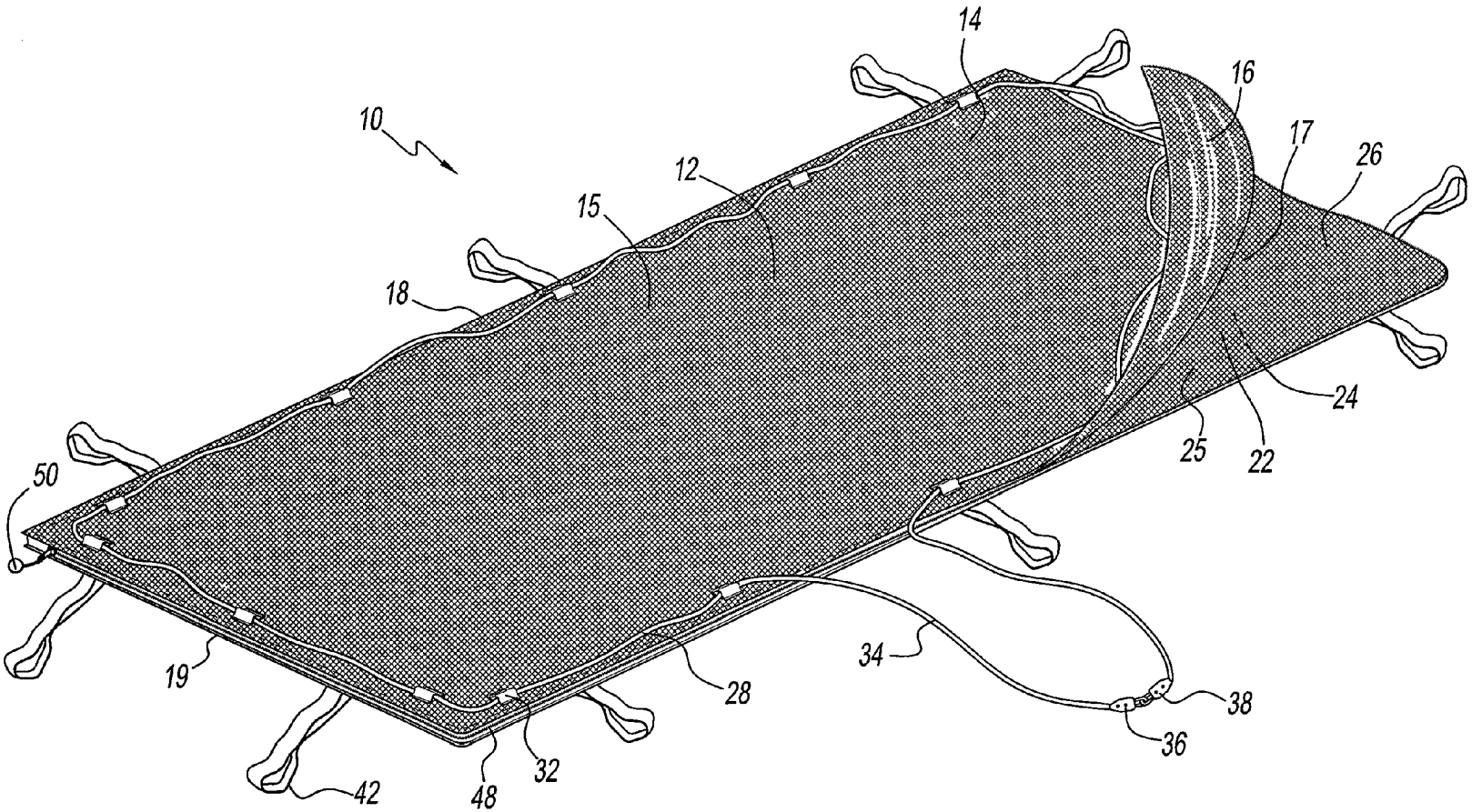
FIG. 1 is a perspective view of an exemplary embodiment of a water retrieval body bag of the present disclosure.
Figure 2:
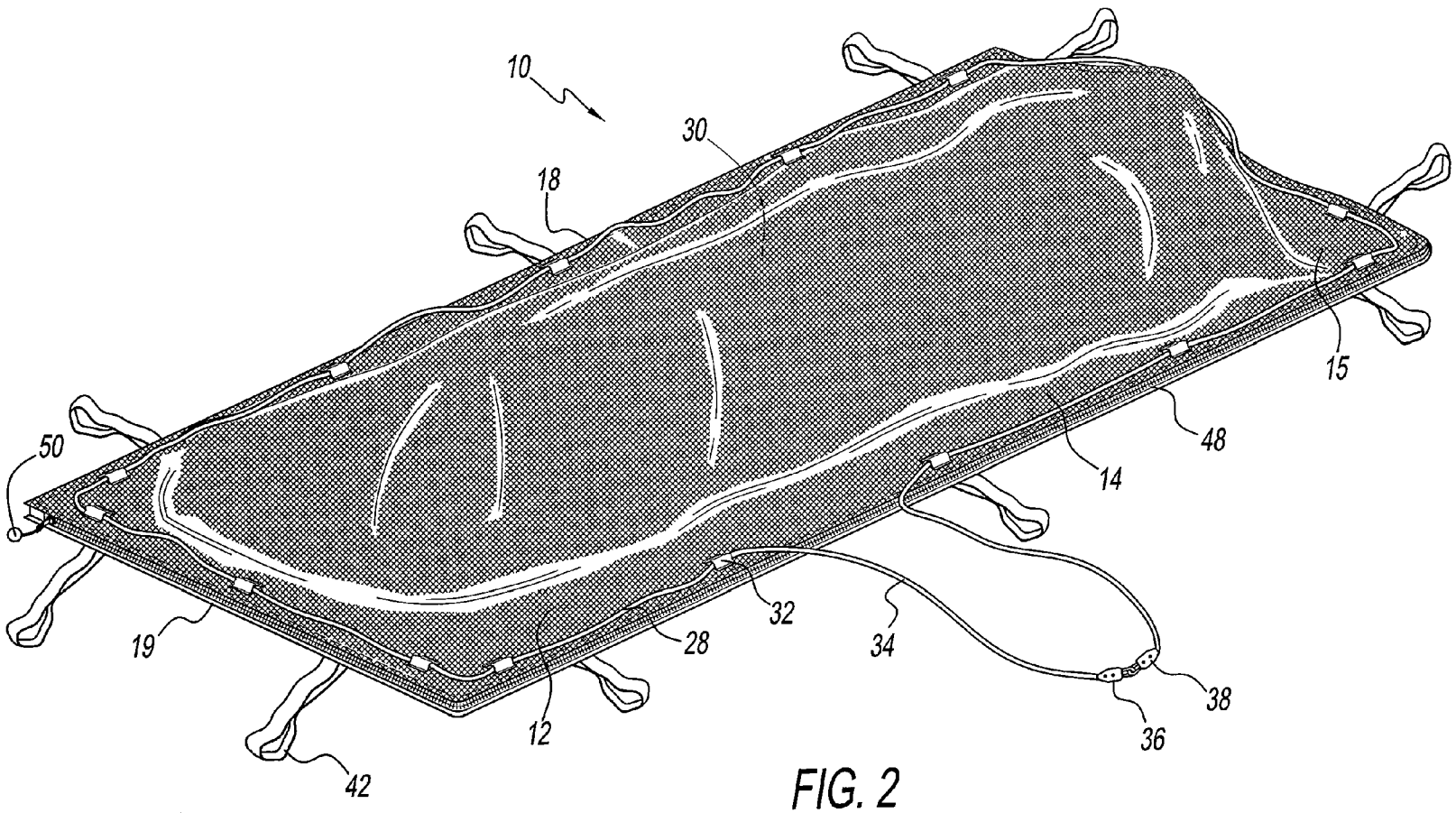
FIG. 2 is a perspective view of the body bag in FIG. 1, enclosing a decedent's body.

Referring to the drawings, and in particular, FIGS. 1 and 2, there is provided a water retrieval body bag generally represented by reference number 10.

As shown in the exemplary embodiment in FIGS. 1 and 2, body bag 10 has a top side 12 and a bottom side 22. Top side 12 and bottom side 22 enclose an interior space 17 in which a decedent's body 30 can be placed. FIG. 1 represents body bag 10 in a "partially open" condition, to visualize interior space 17. FIG. 2 represents body bag 10 in a "closed" condition, enclosing a decedent's body 30 therein.

Top side 12 has top outer surface 14 that forms a top exterior surface of body bag 10. Top side 12 also has a top inner surface 16, opposite to top outer surface 14, that faces toward decedent's body 30 that will be placed in body bag 10.

Similarly, bottom side 22 has a bottom outer surface 24 that forms a bottom exterior surface of body bag 10. Bottom side 22 has a bottom inner surface 26, opposite to bottom outer surface 24, that faces toward a decedent's body 30 that will be placed in body bag 10.

Top side 12 and bottom side 22 can be formed from a single piece of material that is folded along a lengthwise edge 18, as shown in the exemplary embodiment in FIGS. 1 and 2, or along a widthwise edge 19, to form interior space 17. Alternatively, top side 12 and bottom side 22 are separate pieces of material that are connected along a seam line (not shown) along lengthwise edge 18, or widthwise edge 19, to form interior space 17.

In an exemplary embodiment, top side 12 and bottom side 22 are made of a scrim mesh material, such as, but not limited to, a polyester scrim mesh. In another preferred exemplary embodiment, top side 12 and bottom side 22 are made of a vinyl-coated polyester scrim mesh. The scrim mesh provides structural support for the vinyl coating, as well as additional tensile strength, tear strength, dimensional stability, and resistance to elongation of body bag 10. In an exemplary embodiment, the polyester scrim mesh for top side 12 and/or bottom side 22 is 20×20 1000 Denier. However, a smaller yarn denier (i.e., having more yarns per linear square inch) can be used to improve the overall integrity and strength of the polyester scrim mesh, such as a yarn size in the range of 750 to 1250 Denier, and preferably 840 to 1000 Denier. However, yarn sizes below 750 Denier are also suitable for a body bag 10 of the present disclosure.

A vinyl coating can be applied to a scrim mesh to make the outer surfaces of body bag 10 smooth and wear-resistant. The vinyl coating also increases water resistance, mildew resistance, and flame retardancy. The scrim mesh can be coated with a polyvinyl chloride (PVC) coating, such as vinyl ORANISOL® or PLASTISOL®. Alternatively, the scrim mesh can be coated with a polyvinyl fluoride coating, such as TEDLAR®, to form a thicker fabric that is UV-resistant and chemical-resistant for use in industrialized areas, deserts, and coastal zones. A vinyl coating can be made in a color that improves the visibility of body bag 10, which is particularly beneficial when using body bag 10 underwater.

In an exemplary embodiment, the weights of the vinyl-coated scrim mesh for top side 12 and bottom side 22 are between about six (6) to about twenty-four (24) ounces per square yard. In a preferred embodiment, the weights of the vinyl-coated scrim mesh are between eighteen (18) to twenty-two (22) ounces per square yard.

An exemplary embodiment of body bag 10 has a grab tensile strength of about 450-600 lbs. per inch×about 450-600 lbs. per inch, to support about 500 lbs. per square inch.

An adhesive can be applied during manufacture of the vinyl coating of the scrim mesh to chemically bond the polyester fibers of the scrim mesh and the vinyl coating, to reduce delamination, strengthen seams, and reduce wicking (i.e., fibers absorbing water). An embodiment of an adhesive for the present disclosure has adhesion strength of 25 lbs. per square inch.

Additional coatings can be applied to the yarns to resist mildew, dirt, mold, and staining, reduce capillary absorption, and/or increase UV-resistance and water repellency.

Top side 12 has a plurality of holes 15 (also called "perforations" or "apertures" herein) that permit water or other fluid to drain out of body bag 10. Likewise, bottom side 22 is made of a material having a plurality of holes 25 that permit water or other fluid to drain out of body bag 10.

An important feature of the present disclosure is that the selection of the specific ratio of holes 15, 25 per unit weight of material for drainage through top side 12 and bottom side 22 must be balanced against the need to maintain sufficient strength and integrity of body bag 10 when transporting a decedent's body, as well as the need to reduce cross-contamination between the decedent's body and the water. If holes 15, 25 are large, there is rapid fluid drainage but a reduction of strength of body bag 10, and increased risk of cross-contamination. Conversely, if holes 15, 25 are very small, water and fluid do not drain quickly enough from body bag 10. Through experimentation, it was determined that a large number of small-diameter holes were generally more advantageous than having a small number of large-diameter holes for drainage, overall strength, and for reducing cross-contamination. It was found that a ratio that is between about 10×10 holes per square inch to about 13×13 holes per square inch provided good water drainage and reduced cross-contamination, while maintaining sufficient strength and integrity of body bag 10. More preferably, it was found that a ratio of 11×11 holes per square inch provided the best performance for water drainage, cross-contamination, strength and integrity of body bag 10.

However, it is not necessary that all of top side 12 and bottom side 22 have holes 15, 25, as long as at least a portion of either top side 12 and/or bottom side 22 has holes 15, 25 that permit water and fluid to drain from body bag 10. Top side 12 and bottom side 22 can have different ratios of holes 15, 25 per unit area of material, so that drainage through top side 12 can be at a different rate than through bottom side 22.

Holes 15, 25 can be formed in any shape that permits water to drain from body bag 10, including, but not limited to, rectangular, square, circular, and/or oval shaped holes.

In addition, water drainage rates through body bag 10 can be regulated by selecting a material for top side 12 having a different thickness (basis weight), and/or having a different water permeability, as compared with bottom side 22.

Water drainage can also be enhanced or diminished by coating or treating top side 12 and/or bottom side 22 with one or more surfactants. The one or more surfactants can be anionic, cationic, non-ionic, or amphoteric surfactants, including, but not limited to, polyethylene glycol, polypropylene glycol, polysorbates, sulfosuccinates, SILASTOL® (Schill & Seilacher, Boblingen, Germany), fatty amine oxides, linear alcohol ethoxylates, alkanolamides, alkylphenol ethoxylates, block co-polymers of ethylene oxide and propylene oxide, alkylphenol ethoxylates, alkylphenol polyethylene glycol ethers, and any salts and/or any combinations thereof.

Figure 3:
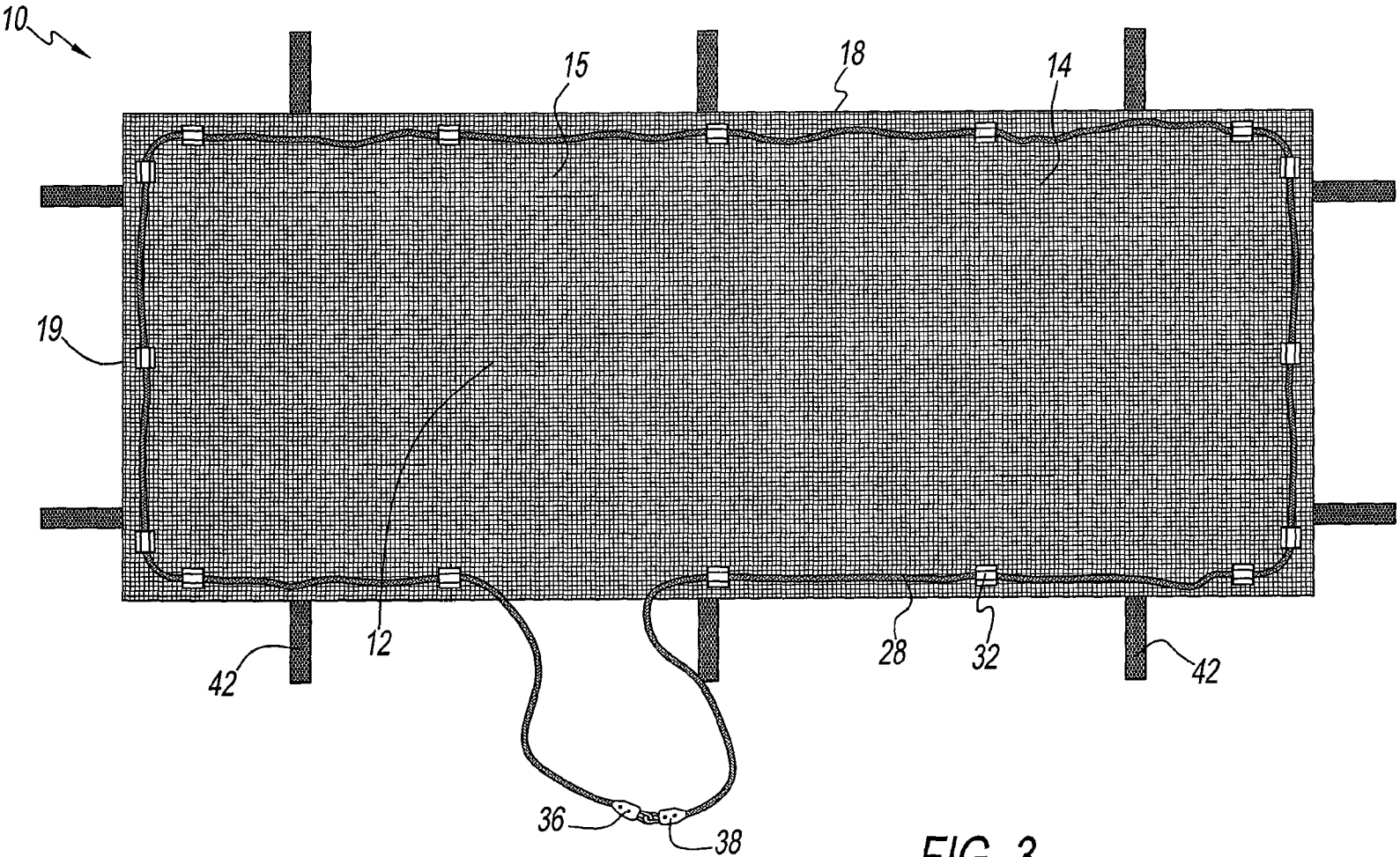
FIG. 3 is a top view of the body bag in FIG. 1.

As shown in the embodiment in FIGS. 1 to 3, a snag line 28 can be disposed on top side 12 around the periphery of body bag 10. Snag line 28 (which can also be called a "tether," interchangeably) is a line or cord that is slidably connected to body bag 10 by one or more loops 32. Snag line 28 has multiple uses, including serving as a line that can be grappled or snagged with a boat hook to pull or tug body bag 10 in water. One or more loops 32 are connected to top side 12 with an open passage through which snag line 28 is passed, permitting snag line 28 to move freely through the one or more loops 32, like a drawstring, on the top outer surface 14 of body bag 10. One or more loops 32 are connected to top side 12 with thread (i.e., sewn), or with adhesive material, such as glue, tape, and/or a hook-and-loop interlocking device such as VELCRO®. In another embodiment (not shown), snag line 28 can be slidably connected on bottom outer surface 24 by similarly-positioned loops around the periphery of body bag 10. Two ends 36, 38 of snag line 28 can be joined so that snag line 28 forms a drawstring about a periphery of body bag 10.

Snag line 28 is of sufficient length to extend around an outer periphery of body bag 10. In the exemplary embodiment in FIGS. 1 to 3, snag line 28 has a surplus length 34 that produces a slack portion for even easier gripping or maneuverability by rescue personnel wearing diving gear or protective hand covers. Surplus length 34 can be about twelve inches (12") (31 cm) to about seventy-two inches (72") (183 cm) in length. In an exemplary embodiment, surplus length 34 is about twenty-four inches (24") (61 cm) in length.

Snag line 28 is made of a material that retains strength when saturated, including, but not limited to, a line or cord made of polyester, or a blend of polyester and nylon. Snag line 28 can be made of a material having a little elasticity but preferably having little stretch, so that snag line 28 can be pulled by a diver to move body bag 10 in the water. Snag line 28 can serve as an additional closure that can be pulled as a drawstring to cinch body bag 10 around a decedent's body 30. Snag line 28 can be made of a material having a small amount of buoyancy, but should not be so buoyant as to retard submersion of body bag 10 in water. Snag line 28 can be made of a color material or dyed to improve visibility, particularly when body bag 10 is submerged.

Snag line 28 provides additional maneuverability and ease of control of body bag 10 by a diver or other rescue specialist while manipulating the body bag underwater, on the water surface, or on a recovery vehicle (such as a boat or any vehicle used for retrieving bodies in water). Snag line 28 also makes it easier for divers and/or other rescue personnel to pull body bag 10 through the water while swimming.

One or more straps 40 are connected to body bag 10. One or more straps 40 provide support for body bag 10. In the exemplary embodiments in FIGS. 1 to 4, straps 40 are connected to bottom outer surface 24 of body bag 10. In an exemplary embodiment, straps 40 are each about one-and-a-half inches (1½") (4 cm) wide, and have a strap tear strength (also called "tongue tear strength") of about 85-100×85-100 lbs.

Figure 4:
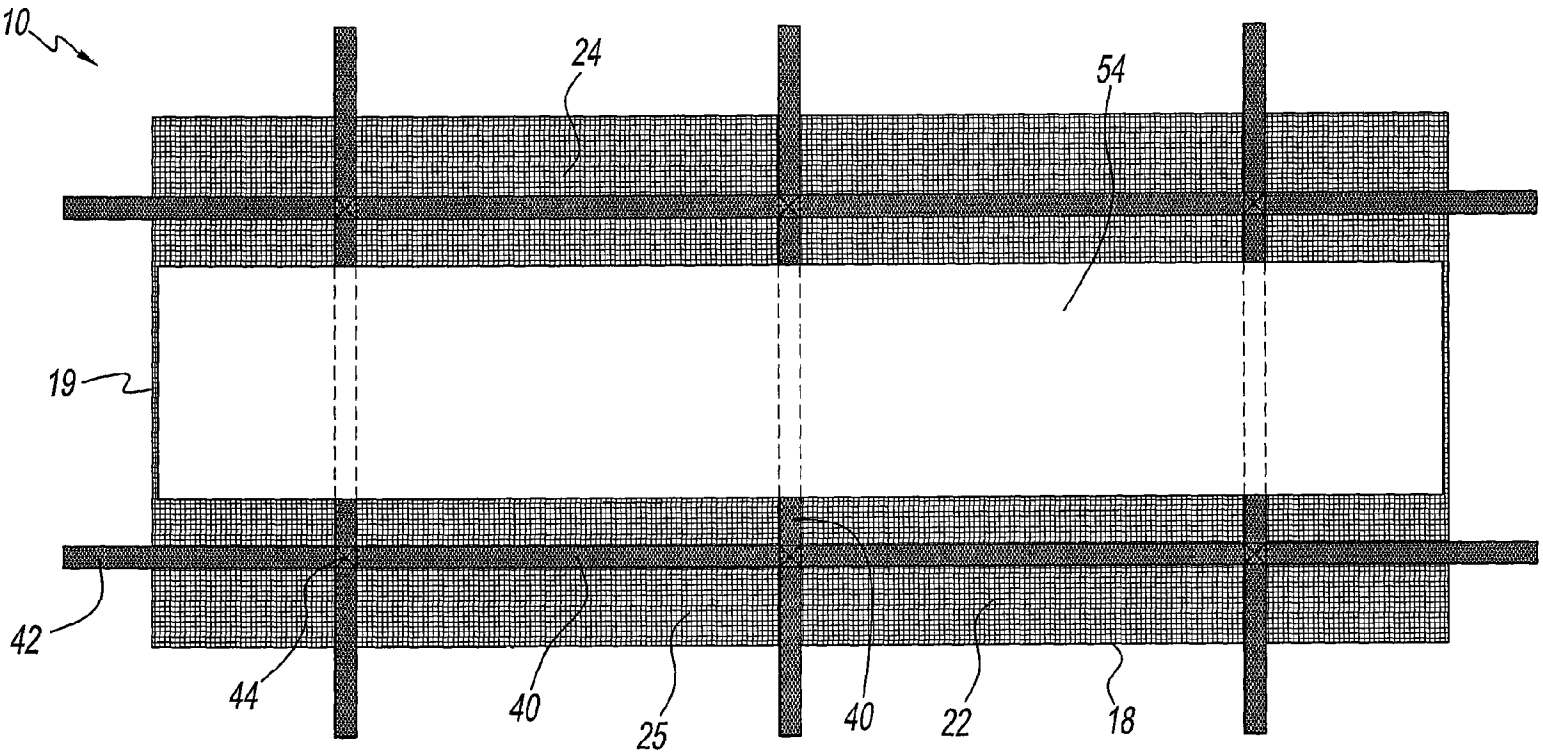
FIG. 4 is a bottom view of the body bag of FIG. 1.

As shown in FIGS. 1 to 4, one or more straps 40 are looped over at the ends and connected to body bag 10 to form one or more loop handles 42 that extend beyond the perimeter of body bag 10, for gripping body bag 10. FIG. 4 is an embodiment where a loop handle 42 is connected to bottom outer surface 24 at an attachment point 44 where two straps 40 overlap each other, thereby forming a large loop handle 42. As used herein, a "large" loop handle 42 is a loop that is at least large enough to permit the fingers of a gloved hand to pass through to grip the loop. In an exemplary embodiment, "large" loop handle 42 is a doubled-over portion of strap 40 that extends about eighteen inches (18") (46 cm) from attachment point 44 (i.e., loop handle 42 is about thirty-six inches (36") (91 cm) of strap 40 that is folded over itself and reconnected at attachment point 44 to form a loop). A looped end of strap 40 is connected to body bag 10 at a corresponding attachment point 44, by any fastening device, including, but not limited to, thread (i.e., is sewn down), and/or by a hook-and-loop interlocking device, such as VELCRO®. In the exemplary embodiment in FIG. 4, ten (10) loop handles 42 and six (6) attachment points 44 are shown. In a preferred exemplary embodiment, one attachment point 44 is about five-and-a-half inches (5½") (14 cm) inward from the nearest lengthwise edge 18, and about twelve inches (12") (31 cm) inward from the nearest widthwise edge 19. Straps 40 can be made with extra lengths of material to further increase the size of one or more loop handles 42.

The extra size of loop handle 42 provides a buoyancy float point where buoyancy devices (not shown) can be connected to body bag 10 through one or more loop handles 42. An example of a buoyancy device is a buoyancy bag. Buoyancy devices provide an easier way to recover bodies underwater. In many cases, the decedent's body is not brought all the way to the surface before being processed and secured within body bag 10. For example, in some instances it is beneficial to process the decedent's body in 50 feet or less of water. In such instances, one or more buoyancy bags can be connected through loop handles 42. The extra size of loop handle 42 also makes it easier for a diver to grasp the loop handle with the full hand while wearing a large scuba glove even when a buoyancy device is present.

For vertical lift of body bag 10, a harness assembly (not shown) can be connected to straps 40 and/or loop handles 42, which can be connected to a mechanical winch (not shown), helicopter, or any other mechanical device providing lift, to lift body bag 10 from the water and for transport. Straps 40, which pass widthwise and lengthwise on the bottom side of body bag 10, support the weight of body bag 10 and decedent's body 30, thereby providing a uniform and distributed weight for lifting.

Body bag 10 has one or more closure devices 48 around the perimeter of body bag 10 that connects top side 12 to bottom side 22 to completely enclose a decedent's body 30. One or more closure devices 48 permit body bag 10 to be opened and closed as needed to place a decedent's body 30 therein, and to remove the decedent's body after transport. As shown in FIGS. 1 and 2, closure device 48 is a zipper that extends along one lengthwise edge and two widthwise edges, permitting body bag 10 to be opened and closed in a "clamshell" configuration. In another embodiment, closure device 48 is a hook-and-loop interlocking device, such as VELCRO®. Closure device 48 may extend along part or all of one, two, three, or (all) four sides of body bag 10, to permit ingress and egress of decedent's body in body bag 10. Ball-and-string 50, or a similar easy-to-grasp device, can be connected to closure device 48 (e.g., looped through the end of the zipper), to make it easier to open and close body bag 10 underwater, even if wearing large scuba gloves or other protective hand gear.

Body bag 10 has a skid pad 54 (also called a "skid plate" or "material segment" herein) that is connected to one side of body bag 10 to provide a smooth surface that permits body bag 10 to be pulled over the gunwale or slide along the sides of a recovery vehicle (such as a boat) without snagging. Skid pad 54 greatly reduces the amount of lifting force needed to lift body bag 10 (laden with decedent's body 30 inside) out of the water and over the gunwale into a recovery vehicle. The skid pad also reduces damage to the decedent's body that can occur when retrieved from water and lifted on a recovery vessel in this manner. As shown in the exemplary embodiment in FIG. 4, skid pad 54 is generally disposed on a center portion of body bag 10, since recovery of a decedent's body in water tends to cause the body (and the center of gravity) to collect at the center of body bag 10.

Skid pad 54 is made of any solid material having a smooth surface that is strong and tear-resistant, including, but not limited to, polyvinyl chloride (PVC). In a preferred embodiment, skid pad 54 extends longitudinally the entire length of body bag 10, from one widthwise edge to the opposite widthwise edge, to eliminate snag points, and permitting skid pad 54 to be connected to body bag 10 at the edges. In an exemplary embodiment, skid pad 54 is about ten inches (10") (25 cm) to about eighteen inches (18") (46 cm) in width, and the same length as the lengthwise dimension of body bag 10. In a preferred embodiment, skid pad 54 is about twelve inches (12") (31 cm) to about fifteen inches (15") (38 cm) in width. Skid pad 54 is sized to provide a large sliding surface without significantly interfering with drainage of water from body bag 10.

An exemplary embodiment of body bag 10 of the present disclosure has outer dimensions that are between about 30 inches (30") (76 cm) to about forty-eight inches (48") (122 cm) in width, by about eighty inches (80") (203 cm) to about one-hundred-ten inches (110") (279 cm) in length. In a preferred embodiment, body bag 10 has outer dimensions of about thirty-six inches (36") (91 cm) in width by about ninety-five inches (95") (241 cm) in length.

An alternative embodiment of body bag 10 is a "half-sized" body bag to enclose and secure bodies of decedents who are children or small adults, that have outer dimensions of about thirty-six inches (36") (91 cm) in width (i.e., the same as for the full-size body bag) by about forty-eight inches (48") (122 cm) in length (i.e., about half of the length of a full-sized body bag 10).

The smaller-sized body bags 10 can also be used to secure and transport detached body parts that are found in water. In addition, the smaller-dimensioned body bags 10 can be used to enclose and/or transport the bodies of animals that have died and are found in water.

The strength and integrity of the body bags used for water retrieval of human remains is critical, as the body bag must support the weight of a deceased person being lifted from water (which tends to concentrate the decedent's body weight in one location at or near the center) and when the body bag is saturated. For this reason, an exemplary embodiment of body bag 10 of the present disclosure is able to support at least 300 lbs. (136 kg) of weight, and a preferred embodiment of body bag 10 is able to support at least 450 lbs. (205 kg) of weight.

As used in this disclosure, the word "about" for dimensions, weights, and other measures, means a range that is ±10% of the stated value, more preferably ±5% of the stated value, and most preferably ±1% of the stated value, including all subranges therebetween.

The present disclosure further provides a method for using a body bag for water retrieval of the present disclosure that includes: opening a body bag having a top side and bottom side, where the top side and/or bottom side are made of a material having holes in a selected ratio that permit drainage of water but maintain the strength and integrity of the body bag; submerging the body bag in water where the decedent's body is located; placing the decedent's body inside the body bag; closing the body bag to completely enclose the decedent's body; and transporting the body bag containing the decedent's body out of the water to a recovery vehicle on the surface of the water or on land.

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances that fall within the scope of the appended claims.

What is claimed is:

1. A body bag for retrieval of a deceased body from water, comprising:

a top side;

a bottom side opposite said top side;

a closure device connecting said top side and said bottom side to form an interior space in which the deceased body, when placed therein, is completely enclosed; and a skid pad connected to said bottom side that provides a smooth surface to slide over the sides and/or gunwale of a recovery vehicle without snagging;

wherein said top side and/or said bottom side are made of a mesh material having a plurality of holes that permit water to drain from at least said interior space of the body bag, and wherein the body bag secures and transports the deceased body found in the water without tearing or breaking.

2. The body bag according to claim 1, further comprising a vinyl coating on said mesh material.

3. The body bag according to claim 1, further comprising a snag line that is connected to said top side or said bottom side of the body bag.

4. The body bag according to claim 3, wherein said snag line extends around a periphery of the body bag.

5. The body bag according to claim 3, wherein said snag line has a surplus length that produces a slack portion for easier gripping and maneuverability of the body bag.

6. The body bag according to claim 1, further comprising one or more straps connected to said bottom side to provide support for the body bag.

7. The body bag according to claim 6, wherein at least one of said one or more straps is looped over to form a loop handle that extends beyond a perimeter of the body bag.

8. The body bag according to claim 7, wherein said loop handle is connected to said bottom side at an attachment point located inward from a lengthwise edge and from a widthwise edge to form a large loop handle.

9. The body bag according to claim 1, wherein said closure device is a zipper that extends along one or more sides of the body bag.

10. The body bag according to claim 1, wherein said skid pad is polyvinyl chloride (PVC).

11. The body bag according to claim 1, wherein said mesh material has a plurality of holes in an amount between about 10×10 holes per square inch to about 13×13 holes per square inch.

12. The body bag according to claim 1, wherein said mesh material has a plurality of holes in an amount of about 11×11 holes per square inch.

13. The body bag according to claim 1, wherein the body bag supports at least 300 pounds of weight after removal from submersion in the water without tearing or breaking.

14. A method of using a body bag for retrieval of a decedent's body from water comprising:

opening said body bag in the water, wherein said body bag comprises:

a top side;

a bottom side opposite said top side;

a closure device connecting said top side and said bottom side to form an interior space in which the decedent's body placed therein is completely enclosed; and a skid pad connected to said bottom side that provides a smooth surface to slide onto a recovery vehicle without snagging;

wherein said top side and/or said bottom side are made of a mesh material having a plurality of holes that permit water to drain from at least said interior space of said body bag;

placing the decedent's body in said interior space of said body bag; and closing said body bag to completely enclose the decedent's body while in the water.

15. The method according to claim 14, further comprising using a snag line to transport the body bag containing the decedent's body out of the water.

16. The method according to claim 14, wherein said body bag is opened when submerged in the water.

* * * * *